United States Patent [19]

Guidry

[11] 4,377,917

[45] Mar. 29, 1983

[54] COMBINATION GREETING CARD AND BOUNCEABLE CONTAINER-TOY

[76] Inventor: Robert L. Guidry, 7045 N. 7th St., Apt. 160, Phoenix, Ariz. 85020

[21] Appl. No.: 274,775

[22] Filed: Jun. 18, 1981

[51] Int. Cl.[3] ..... A63H 33/00

[52] U.S. Cl. ..... 46/11; 46/35; 229/41 B

[58] Field of Search ..... 46/35, 1 L, 11; 229/DIG. 3, 41 R, 41 B

[56] References Cited

U.S. PATENT DOCUMENTS 2,791,367 5/1957 Mefford ..... 229/41 R 3,280,871 10/1966 Taylor ..... 229/DIG. 3

3,319,684 5/1967 Calhoun ..... 229/41 R X 3,695,508 10/1972 Hocking ..... 229/DIG. 3 X

*Primary Examiner*—Mickey Yu

*Attorney, Agent, or Firm*—Cahill, Sutton & Thomas

[57] ABSTRACT

A foldable device is openable from a flat configuration having greeting card matter printed thereon to form a box-like upper portion having a hinged cover and a springy, accordian-like base for effecting bouncing of the device when folded. The device can be used as a bounceable toy. The device is made from a single piece of thin cardboard.

4 Claims, 7 Drawing Figures

COMBINATION GREETING CARD AND BOUNCEABLE CONTAINER-TOY

BACKGROUND OF THE INVENTION

1. Field of the Invention

The invention relates to novelty greeting card items, and more particularly, to novelty greeting card items which are unfoldable from a flat configuration to self-form a container.

2. Description of the Prior Art

A large variety of novelty greeting cards that can be folded into flat configurations for convenient mailing in an envelope and unfolded to self-form various types of novelty items are known. For example, U.S. Pat. No. 2,906,058 discloses a greeting card having four rectangular panels, each hingeably connected to another. A bellows is provided between two of the panels and operates in conjunction with a whistle mounted in a hole formed in one of the panels, so that when the greeting card is opened and closed, the bellows draws in and expels air through the whistle, creating an audible sound. U.S. Pat. No. 3,010,246 discloses a self-forming figure that can be folded into a flat configuration for placement in an evelope, but which, upon release, automatically springs open to form a three-dimensional figure. Greeting card indicia are provided on various rectangular surfaces of the device. U.S. Pat. No. 2,344,437 discloses a combined greeting card and container. Multiple purpose novelty items capable of functioning both as containers and toys can be very useful in marketing certain kinds of products, as parents will frequently buy such products partly in order to obtain the novelty item as a toy for their children.

SUMMARY OF THE INVENTION

Briefly described, and in accordance with one embodiment thereof, the invention provides a foldable, self-forming device that can be opened from a flat configuration to form a bounceable device having a box-like upper section with a hinged cover and a springy-accordian-like base for effecting bouncing of said self-forming device. In the described embodiment of the invention, greeting card indicia are provided on one or more outer panel surfaces of the device. The accordian-like base includes a plurality of triangular panels that fold inward as the accordian-like base is compressed. The triangular panels fold inward from vertical orientations to horizontal orientations as the accordian-like base is compressed from a fully opened to a fully closed configuration, wherein several of the triangular panels form a portion of a bottom for the box-like upper portion. The accordian-like base also includes several rectangular panels hingeably connected along lower edges of the box-like upper portion and also hingeably connected to several of the triangular panels to effect hinging action necessary to achieve compressing of the accordian-like base. A portion of the inner surface of two of the rectangular panels of the accordian-like base form part of the inner surface of the bottom of the box-like upper portion of the device when the accordian-like base is completely compressed. In the described embodiment of the invention, the self-forming device can be formed of a unitary piece of cardboard with partial cuts along the fold line sections that serve as hinges along the fold line.

It is an object of the invention to provide a self-forming device that, when folded flat, can function as a greeting card, and when open, functions as a container and as a bounceable novelty item.

DESCRIPTION OF THE INVENTION

Figure 1:
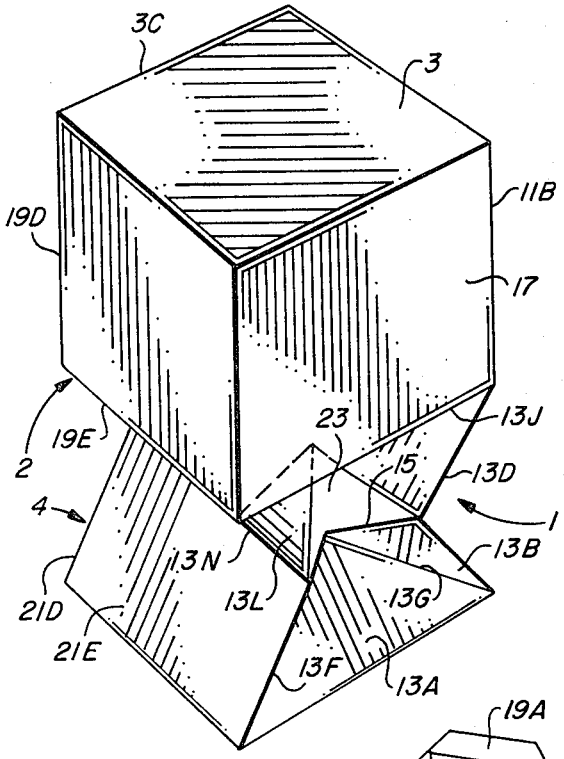
FIG. 1 is a perspective view of the card-container-toy of the present invention.
Figure 2:
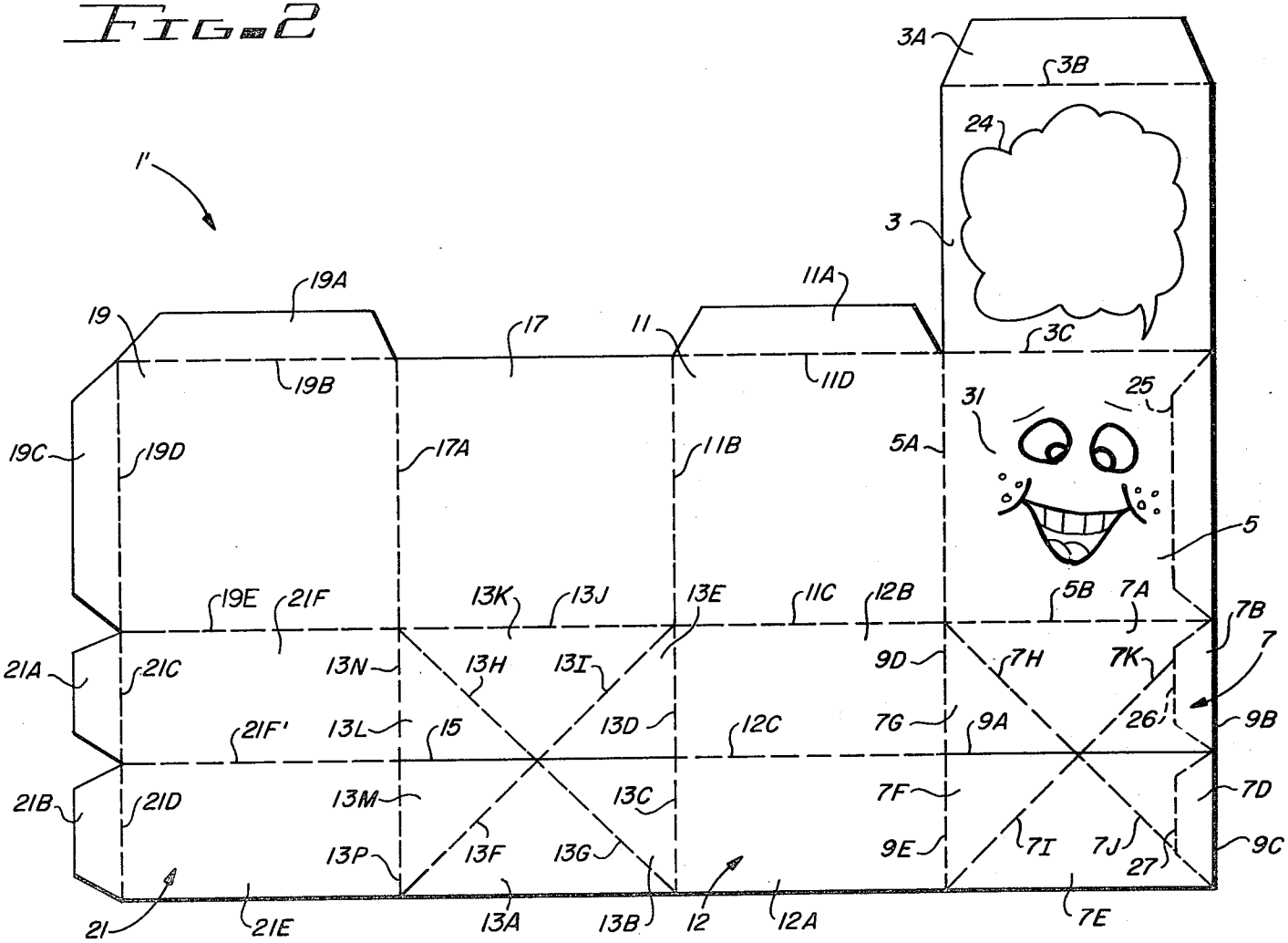
FIG. 2 is a plan view of a single piece of cardboard from which the device of FIG. 1 can be constructed, showing cuts and fold lines.

Referring now to the drawings, particularly FIGS. 1–4, device 1 includes a box-like upper section 2 and an accordian-like lower section 4. Box-like upper section 2 includes four vertical sides 5, 11, 17 and 19, as best seen in FIG. 2, which shows a plan view of a single piece 1′ of cardboard out of which the device 1 is constructed. Box section 2 includes a lid 3 having a flap 3A and is hingeably connected along fold line 3C to back side 5. Lid flap 3A is foldable relative to top 3 along fold line 3B. Side 11 has a flap 11A foldable relative to side 11 along fold line 11D. Side 11 is hingeably connected, along vertical fold line 11B, to front side 17 of box section 2. Side 11 is also connected to back side 5 along vertical fold line 5A. Side 19 is connected to front side 17 along vertical fold line 17A. Side 19 has a top flat 19A and a side flap 19C. Top flap 19A is connected to side 19 along fold line 19B, and side flap 19C is connected to side 19 along fold line 19D. Each of sides 5, 11, 17 and 19 and also top 3 are rectangular, exclusive of the various flaps connected thereto. Fold lines 3C, 11D and 19B are colinear in cardboard section 1′ of FIG. 2.

Lower accordian-like section 4, hereinafter, simply accordian section 4, is hingeably connected to the lower edges of sides 5, 11, 17 and 19 along fold lines 5B, 11C, 13J and 19E, respectively, as shown in FIG. 2. Accordian section 4 includes half-size rectangular panels 21E, 21F, 12A and 12B, and also includes triangular panels 13A, 13B, 13M, 13E, 13K, 13L, 7A, 7B, 7G, 7D, 7E, and 7F.

Triangular panel 7A is connected along horizontal fold line 5B to vertical side 5. Triangular panel 7B is connected along inclined fold line 7K to triangular panel 7A. Triangular panel 7G is connected along inclined fold line 7H to triangular panel 7A, and is also connected along vertical fold line 9D to rectangular panel 12B. A horizontal slit 9A extending through cardboard piece 1′ separates triangular panels 7G, 7A and 7B from triangular panels 7F, 7E and 7D, respectively. Triangular panel 7D is connected along inclined fold line 7J to triangular panel 7E. Triangular panel 7F is connected along inclined fold line 7I to triangular panel 7E. Triangular panel 7F is also connected along vertical fold line 9E to rectangular panel 12A.

Triangular panel 13K is connected along horizontal fold line 13J to front side 17. Triangular panel 13E is connected along vertical fold line 13D to rectangular panel 12B and also is connected along inclined fold line 13I to triangular panel 13K. Triangular panel 13L is connected along vertical fold line 13N to rectangular panel 21F and is also connected along inclined fold line 13H to triangular panel 13K. A horizontal slit 15 extending through precut cardboard piece 1' separates triangular panels 13L, 13K and 13E from triangular panels 13M, 13A and 13B, respectively. Triangular panel 13M is connected along vertical fold line 13P to rectangular panel 21E and is also connected along inclined fold line 13F to triangular panel 13A. Triangular panel 13B is connected along vertical fold line 13C to rectangular panel 12A and is also connected along inclined fold line 13G to triangular panel 13A. The lower horizontal edges of rectangular panels 12A and 21E and of triangular panels 7E and 13A form a continuous bottom edge of accordian base 4 of the completed device 1.

Side tab 21A is connected along vertical fold line 21C to rectangular panel 21F, and side tab 21B is connected along vertical fold line 21D to rectangular panel 21E. Tabs 19C, 21A, and 21B are glued to the opposed edge of precut cardboard section 1' at the surface portions designated by dotted lines 25, 26 and 27, respectively in FIG. 2, after folding the cardboard section 1' in the fashion indicated in FIGS. 3 and 4, in order to produce the device shown in FIG. 1.

Rectangular panel 21F is connected to rectangular panel 21E along horizontal fold line 21F'. Rectangular panel 12A is connected to rectangular panel 12B along horizontal fold line 21C.

Figure 3:
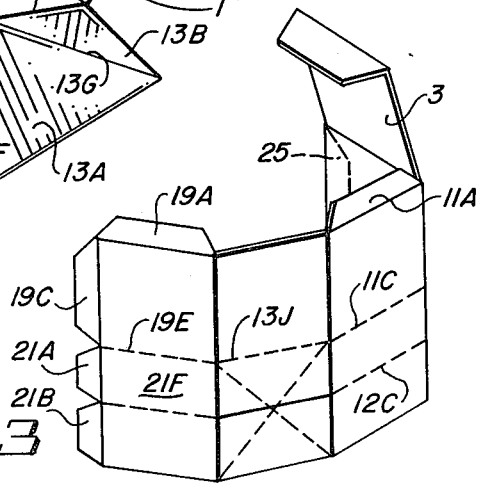
FIG. 3 is a perspective view useful in explaining how the piece of cardboard shown in FIG. 2 is manipulated to make the device of FIG. 1.
Figure 4:
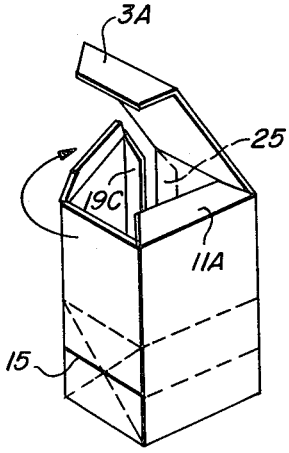
FIG. 4 is a perspective diagram further illustrating making of the device of FIG. 1 from the configuration shown in FIG. 3.

As seen in FIG. 4, top flap 3A and side flaps 19A and 11A are utilized to effect closing of top 3 after the device 1 has been constructed in the fashion indicated in FIGS. 3 and 4.

Any type of suitable indicia can be provided on the various outer surfaces of the various panels. For example, a face 31 can be provided on panel 5, and a message can be indicated in the caption area 24 on lid 3, as shown in FIG. 2.

Figure 5A:
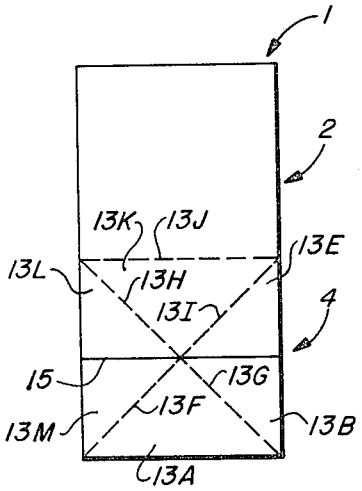
FIGS. 5A–5B are successive front views of the device of FIG. 1 useful in explaining the operation of the accordian-like base of the device shown in FIG. 1.
Figure 5B:
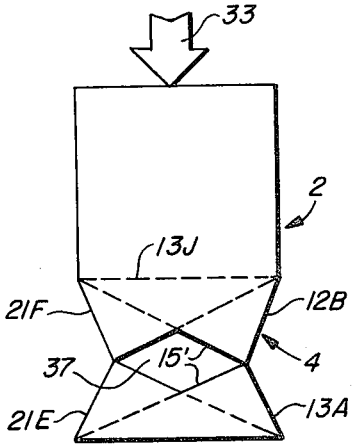
Figure 5C:
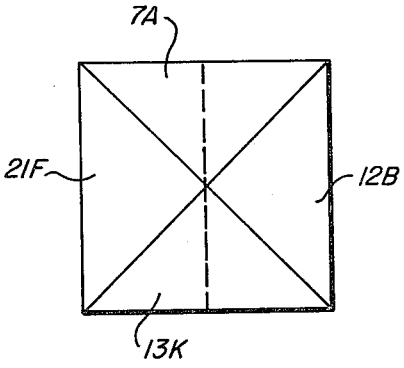
FIG. 5C is a top view of the bottom inside surface of the device of FIG. 1 when the accordian-like base is pressed flat to form a bottom for the upper container.

The bouncing operation of the device 1 is best understood with reference to FIGS. 5A and 5B. 5A shows a front view of the device shown in FIG. 1. (Note that a rear view would be identical to the front view, and therefore is not shown in the drawings). Referring to FIG. 5A, device 1 is shown with its accordian base 4 completely expanded. In this configuration, triangular panels 13A, 13B, 13E, 13L and 13M all lie in the same plane. The opposed edges of horizontal cut 15 touch each other. Panels 17, 13K, and 13A lie in the same plane, and rectangular panels 5, 7A, and 7E lie in the same plane. Then, if a downward force, indicated by arrow 33 in FIG. 5B, is applied, accordian base 4 begins to collapse. The edges 15' of cut 15 begin to spread apart, as triangular panels 13A, 13B, 13E, 13K, 13L, and 13M all begin to fold inward, causing a gap 37 to appear. As the force is increased, all of the above-mentioned triangular panels fold further inward, and the size of opening 37 reaches a maximum point and then begins to decrease and continues decreasing to a point when accordian base 4 is completely collapsed. When the accordian base is completely collapsed, triangular panels 13K and 13A are horizontal and form a portion of the inner bottom surface of a bottom of box section 2, as shown in FIG. 5C, which is a top view of the inside bottom surface of box section 2. The other portion of the inside bottom surface of box 2 is formed by the portions of rectangular panels 12B and 21F that are not covered by triangular panels 13A, and 13K.

The fold lines indicated in FIG. 2 can be made by making appropriate surface cuts in the cardboard piece on the outer surface thereof for all of the vertical fold lines shown in FIG. 2 and by making partial skin or surface cuts on the inner surface of the piece of cardboard for all of the horizontal and inclined fold lines except 5B, 11C, 13J and 19E. The latter horizontal fold cuts are best made on the outer surface of the cardboard piece from which precut piece 1' is cut.

While the invention has been described with reference to a particular embodiment thereof, those skilled in the art will be able to make various modifications to the structure of the disclosed embodiment of the invention without departing from the true spirit and scope thereof. For example, only a single pleat has been shown in accordian section 4, but multiple pleats could be easily provided by continuing the pattern shown in FIG. 2 in a downward direction.

I claim:

1. A foldable, self-forming device that can be opened from a flat configuration to form a bounceable device, said bounceable device comprising:

(a) box-like upper portion with a hinged cover; and (b) a springy, accordian-like base for effecting bouncing of said bounceable device, said accordian-like base including a plurality of panels that fold upward to form a substantially flat bottom of said box-like upper section when said accordian-like base is completely compressed, said panels also folding downward so that there is no bottom of said box-like upper section or said accordian-like base;

said box-like upper section including four rectangular side panels hingeably connected together by means of four vertical fold line hinge sections;

said accordian-like base including i. first and second rectangular panels hingeably connected to bottom edges of first and second opposed side panels of said box-like upper section by means of first and second horizontal fold line hinge sections, respectively;

ii. third and fourth rectangular panels hingeably connected to bottom edges of said first and second rectangular panels by means of third and fourth horizontal fold line hinge sections, respectively;

iii. first and second triangular panels hingeably connected by means of fifth and sixth horizontal fold line hinge sections to bottom edges of third and fourth opposed side panels of said box-like upper section, respectively;

iv. third and fourth triangular panels hingeably connected by means of first and second inclined fold line hinge sections, respectively, to said first triangular panel and also hingeably connected to respective ones of said first and second rectangular panels by means of first and second vertical fold line hinge sections, respectively;

v. fifth and sixth triangular panels hingeably connected by means of third and fourth inclined fold line sections, respectively, to said second triangular panel and to respective ones of said first and second rectangular panels by means of third and fourth vertical fold line hinge sections, respectively;

vi. seventh and eighth triangular panels;

vii. ninth and tenth triangular panels hingeably connected to said third and fourth rectangular panels by means of fifth and sixth vertical fold line hinge sections, respectively, and to said seventh triangular panel by means of fifth and sixth inclined fold line hinge sections, respectively; and viii. eleventh and twelfth triangular panels hingeably connected to said third and fourth rectangular panels by means of seventh and eighth vertical fold line sections, respectively, and to said eighth triangular panel by means of seventh and eighth inclined fold line sections, respectively, said third, first, and fourth triangular panels eing discontinuous with said ninth, seventh and tenth triangular panels, respectively, causing a first gap to open separating said third, first, and fourth triangular panels from said ninth, seventh, and tenth triangular panels, respectively, as said accordian-like base collapses from a fully extended configuration toward a collapsed configuration;

said fifth, second and sixth triangular panels being discontinuous with said twelfth, eighth, and eleventh triangular panels, respectively, causing a second gap to open separating said fifth, second, and sixth triangular panels from said twelfth, eighth and eleventh triangular panels, respectively.

2. The foldable, self-forming device of claim 1 wherein all of said panels and fold line hinge sections are included in a single piece of cardboard.

3. The foldable, self-forming device of claim 2 including first and second tabs hingeably connected along vertical fold line hinge sections to vertical edges of said first and third rectangular panels for fixed connection to edge portions of said sixth and eleventh triangular panels, respectively, and a third tab hingeably connected along a vertical fold line hinge section to one of said four rectangular side panels of said box-like upper section for fixed connection to an edge portion of another of said four rectangular side panels of said box-like upper section.

4. The foldable, self-forming device of claim 2 further including first and second closing tabs hingeably connected to upper horizontal edges of two opposed ones of said four rectangular side panels of said box-like upper box section and a third closing tab hingeably connected to a free edge of said cover.

* * * * *